US006503175B1

(12) United States Patent
Harrell

(10) Patent No.: US 6,503,175 B1
(45) Date of Patent: Jan. 7, 2003

(54) EXERCISE DEVICE

(76) Inventor: Thomas A. Harrell, 9980 W. 51st Pl., Apt. A316, Arvada, CO (US) 80002

( * ) Notice: Subject to any disclaimer, the term of this patent is extended or adjusted under 35 U.S.C. 154(b) by 0 days.

(21) Appl. No.: 09/500,070

(22) Filed: Feb. 8, 2000

(51) Int. Cl.[7] ..... A63B 1/00

(52) U.S. Cl. ..... 482/38; 482/23; 482/34; 482/40

(58) Field of Search ..... 482/23, 34, 39, 482/40, 43, 95–97, 99, 120, 126, 908, 910

(56) References Cited

U.S. PATENT DOCUMENTS

| | | | | |
|---|---|---|---|---|
| 1,430,573 A | | 10/1922 | Lindstrom et al. | |
| 2,938,695 A | | 5/1960 | Ciampa | 248/214 |
| 3,593,996 A | | 7/1971 | Thompson | 272/62 |
| 3,716,232 A | * | 2/1973 | Johnson et al. | 272/63 |
| 4,705,270 A | | 11/1987 | Melton | 272/93 |
| 4,722,523 A | | 2/1988 | Yang | 272/122 |
| 4,779,867 A | | 10/1988 | Hinds | 272/137 |
| 4,787,626 A | | 11/1988 | Gallagher | 272/93 |
| 4,809,971 A | | 3/1989 | Goldish | 272/93 |
| 5,209,712 A | | 5/1993 | Ferri | 482/91 |
| 5,288,283 A | * | 2/1994 | Meeker | 482/69 |
| 5,429,571 A | | 7/1995 | Smith et al. | 482/115 |
| 5,445,585 A | | 8/1995 | Meeker | 482/69 |
| 5,729,844 A | | 3/1998 | Kerstetter | 5/104 |
| 5,776,033 A | | 7/1998 | Brown | 482/40 |

* cited by examiner

*Primary Examiner*—Jerome W. Donnelly
*Assistant Examiner*—Tam Nguyen
(74) *Attorney, Agent, or Firm*—John L. Isaac; Isaac & Associates

(57) ABSTRACT

An exercise device for use with a support frame is disclosed. The device includes a pair of spaced clamp members each having a body portion terminating in first and second edges. A length-adjustable attachment member interconnects the clamp members, and a grip element is associated with the attachment member intermediate the clamp members. A leverage mechanism is operatively connected to the clamp members so that when the clamp member first edges are supported on a frame, the leverage mechanism urges the clamp member second edges laterally inwardly against the support frame in response to a downward force exerted on the grip element.

20 Claims, 6 Drawing Sheets

EXERCISE DEVICE

BACKGROUND OF THE INVENTION

1. Field of the Invention

The present invention relates, generally, to exercise devices and, more particularly, to new and improved portable exercise devices. Specifically, the present invention relates to portable exercise devices which are used in conjunction with overhead doorway frames, are light weight and readily transportable.

2. Description of the Prior Art

Exercising apparatus presently available in the market comes in all sizes and forms. Such devices are designed to exercise all the various types of muscle groups. Moreover, there is an ever increasing need and demand for exercising equipment for use in and around the home. Such equipment is preferably designed to be portable so that it can be easily assembled and disassembled for storage as well as for travel. Examples of such diverse equipment include those devices illustrated in U.S. Pat. Nos. 1,480,573, 2,938,695, 4,705,270, 4,722,523, 4,779,867, 4,787,626, 4,809,971, and 5,209,712. As can be seen from these devices, a wide variety of types of exercise are represented with these devices, including sit-ups, chin-ups, push-downs, stretches and the like.

Chinning, as a form of exercise, is widely enjoyed and to a large extent is practiced indoors with the aid of a chinning bar of some type. Typical examples of this type of equipment include temporarily attachable devices which are commonly installed between or along the jambs of a doorway. Specific examples of this type of device are shown in U.S. Pat. Nos. 3,593,996, 3,716,232, 5,429,571 and 5,776,033. While many of these devices are adequate, many are either difficult to install, are limited as to the amount of weight that they can carry, or are too cumbersome to be truly easily portable. Some of these devices are designed to hang from the top edge of a door frame. Unfortunately, these devices are very limited as to the amount of weight they can carry since they place a substantial load factor onto the door frame edge, which may be pulled out from its attachment to the doorway. Until the weight depending from this device can be somehow distributed elsewhere other than on the frame's edge, this weight limit factor is a significant issue to such prior art chinning bars attachable to doorways. Moreover, the use of a bar also limits the portability of such prior art devices.

SUMMARY OF THE INVENTION

Accordingly, it is one object of the present invention to provide a portable exercise device that is designed to be utilized with the frame of a doorway without placing unacceptable weight onto the doorway frame edge.

It is another object of the present invention to provide a portable exercise device that is lightweight, small and compact for storage, and easily transportable for travel.

Yet another object of the present invention is to provide a portable exercise device that is adjustable to all sizes of doorway jams and wall widths without the use of a bar.

Still another object of the present invention is to provide a portable exercise device that is adjustable to different positions for different arm width placements to accomplish different workouts.

To achieve the foregoing and other objects and in accordance with the purpose of the present invention, as embodied and broadly described herein, an exercise device for use with a support frame is disclosed. The device includes a pair of spaced clamp members each having a body portion terminating in first and second edges. A length-adjustable attachment member interconnects the clamp members, and a grip element is associated with the attachment member intermediate the clamp members. A leverage mechanism is operatively connected to the clamp members so that when the clamp member first edges are supported on a frame, the leverage mechanism urges the clamp member second edges laterally inwardly against the support frame in response to a downward force exerted on the grip element.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE PREFERRED EMBODIMENTS

Figure 1:
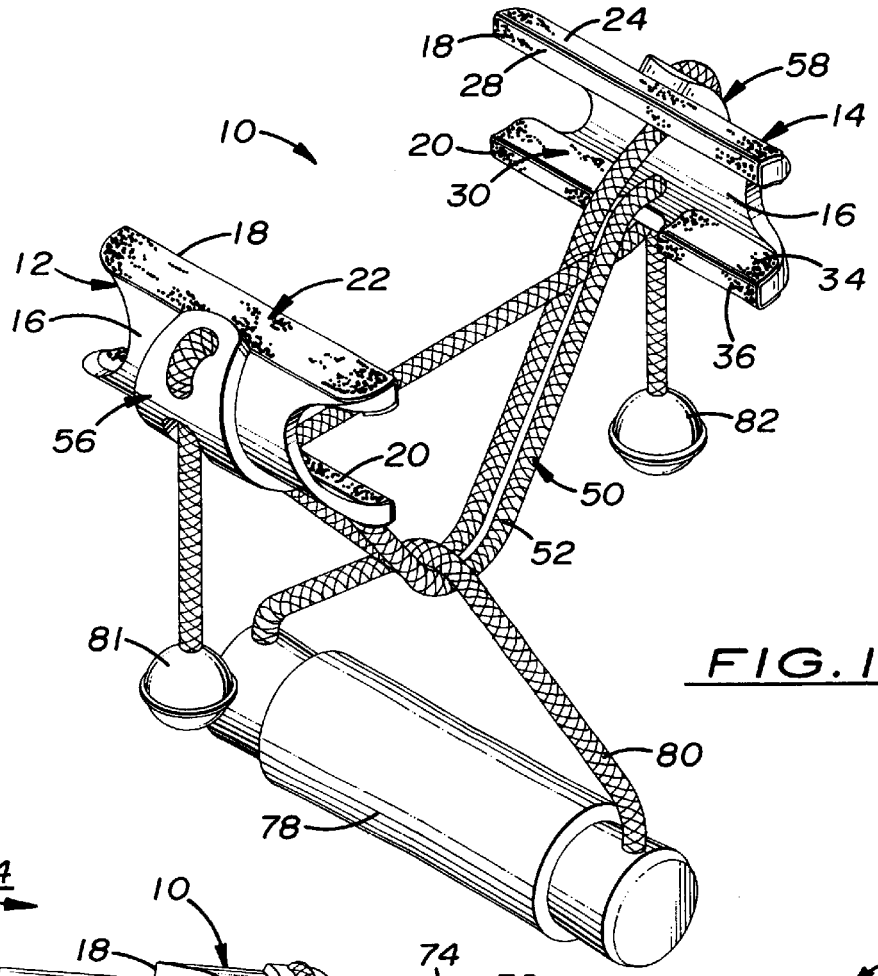
FIG. 1 is a perspective view of one exercise device embodiment constructed in accordance with the present invention.
Figure 2:
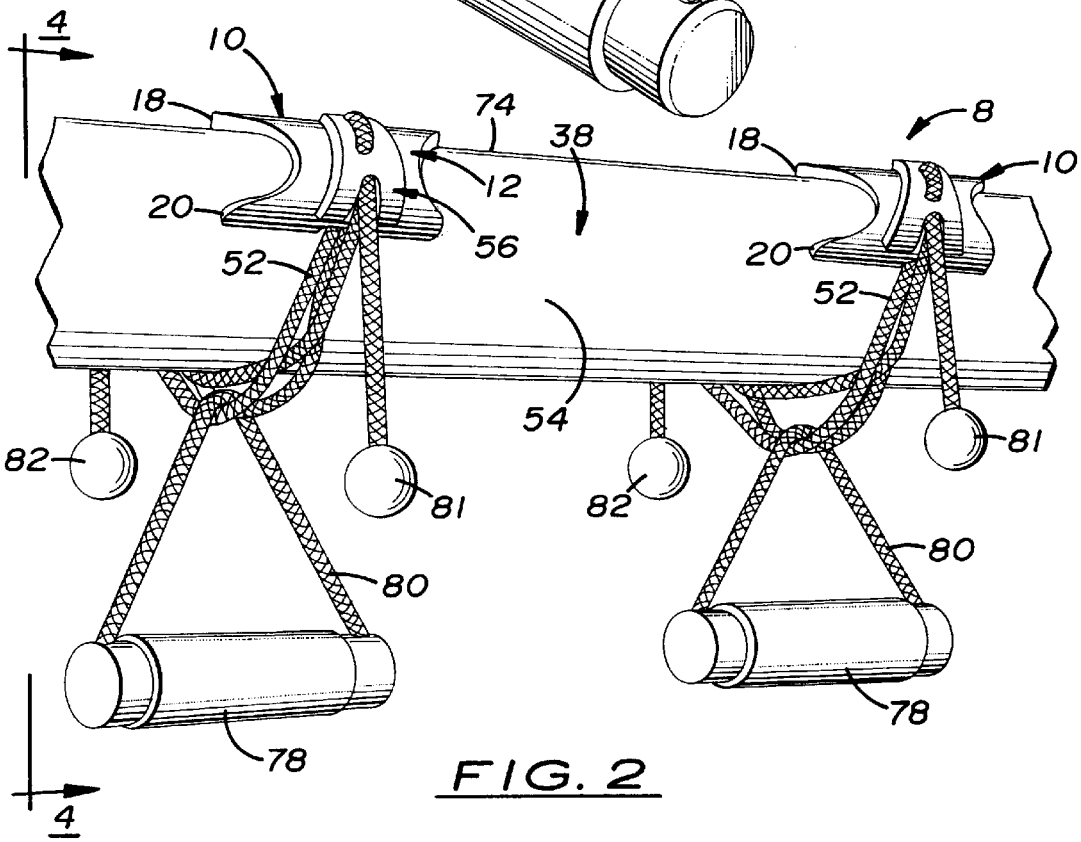
FIG. 2 is a perspective view of an exercise device using the embodiment of FIG. 1 and installed onto a door frame.

The present invention is an exercise device that uses a pair of independently attachable and adjustable exercise units to accomplish its goal. Preferably, the device of the invention is used for performing chin-ups, dips and the like. The device is intended for use with a doorway frame so that the two units of the device may be independently attached to the upper or side frame of the doorway. In preferred form, the invention units are foldable into pocket size for easy storage and transport. They preferably weigh less than 1 lb. together and are positionable along a doorway frame so that different workout widths and positions may be used. As will be seen from the description provided below, the units of the exercise device are locked into position on the doorway by pulling outwardly on the grips of the units. However, this action substantially eliminates any downward force on the doorway frame by the units by translating it into a lateral force against the outer surface of the door frame. While the present invention is particularly illustrated in its form hanging from the upper frame of a doorway for use in performing chin-ups, it should be understood that the invention may also be attached to the side door frame on each side of the door opening for dips, legs raises, and the like.

In addressing the first embodiment of the invention, FIGS. 1–9 are illustrated. In this embodiment of the invention, the device 8 of the invention includes a pair of individual exercise device units 10 which are preferably constructed in substantially identical manner. Each exercise device unit 10 includes a pair of clamp members 12, 14, which preferably are substantially identical to each other. In such instances, like elements will carry like numerals throughout the figures.

Each clamp member 12, 14 includes a body portion 16 having a first elongated edge 18 and a second elongated edge 20. Preferably, the body portion 16 is a jaw-like member having an arcuate cross-section, with the first and second edges 18, 20 being disposed opposite each other. In most preferred form, the body portion 16 is semicircular in cross-section and is constructed from a PVC pipe section sliced longitudinally. It should be understood, however, that the body portion 16 may be made from a variety of shapes and materials.

Referring in particular to FIGS. 1, 4, 4A and 5–8, the details of the device 10 are illustrated. In this embodiment, the first elongated edge 18 of each clamp member 12, 14 preferably includes a friction surface member 22, such as friction tape, to be positioned along the exterior 24, interior 26 and front 28 edges of the first elongated edge 18. Likewise, the second elongated edge 20 of each clamp member 12, 14 preferably includes a friction surface member 30, such as friction tape, to be positioned along the exterior 32, interior 34 and front 36 edges thereof. The friction surface members 22, 30 enable the clamp members 12, 14 to be securely positioned onto a door frame 38 prior to weight being applied to the device 10 as described in greater detail below. In preferred form, the body portion 16 of each member 12, 14 has an interior surface 40, an outer surface 42, and a notch 44 created at the middle of the second elongated edge 20. A pair of apertures 46, 48 are defined in the body portion 16 at the mid-portion thereof and proximate to the first elongated edge 18 and second elongated edge 20, respectively.

A length adjustable attachment member 50 interconnects the clamp members 12, 14 in a manner that permits the clamp elements 12, 14 to be removably attached to each side of a doorway frame 38. It should be noted that the device 10 of the invention can be attached to an upper door frame for chin-ups as well as to a side door frame for dips, leg raises and the like. In preferred form, the attachment member 50 is a cord or rope 52 which is interwoven between the two clamp members 12, 14 in a manner described below. It should be understood, however, that any length-adjustable attachment member may be used with the present invention.

The device 10 also includes a leverage mechanism which is operatively connected to the attachment member 50 and the clamp members 12, 14 in a manner which urges the clamp member second elongated edges 20 laterally inwardly against the outer surface 54 of a doorway frame 38. In this embodiment of the invention, the leverage mechanism is preferably in the form of a pair of leverage brackets 56, 58. Each bracket 56, 58 is substantially identical in construction and preferably includes an arcuate body portion 60 which has an interior surface 62 shaped to conform to the outer surface 42 of the clamp member 12. The body portion 60 of each bracket 56, 58 also includes an outer surface 64, a pair of apertures 66,68 and a notch 70 disposed along the bottom edge 72 thereof. The apertures 46, 48 of the clamp members 12, 14 and the apertures 66, 68 of the brackets 56, 58 are utilized in conjunction with the cord 52 to interconnect the clamp members 12, 14 and the leverage brackets 56, 58.

Referring particularly to FIGS. 1–4A, the clamp members 12,14 are designed to be placed against a doorway frame 38 so that the first edge 18 engages the top edge 74 of the frame 38 while the second edge 20 engages the outer surface or face 54 of the frame 38. Typical prior art devices, however, have their first edge hanging onto the top edge 74 of the doorway frame 38 while the bottom edges thereof hang below the doorway 76, thereby placing all the weight imposed on the device onto the top edge 74. This is not well advised since many door frames are not necessarily firmly attached to frame studs, thereby risking the possibility that the entire frame structure may be pulled down and off the doorway. The leverage mechanism of the present invention, however, prevents this from occurring.

In this one preferred embodiment, the clamp elements 12, 14 are interconnected by the cord 52. A handle grip 78 is attached to the cord 52 by a loop 80 from the grip 78 passing over the loops of the cord 52. The cord 52 is interwoven between the clamp members 12, 14 and the brackets 56, 58 so that the first elongated edges 18 of the clamp members 12, 14 rest on the top edges 74 of opposite door frames 38. The second elongated edges 20 rest against the outer surface or face 54 of opposite door frames 38. The brackets 56, 58 are snugly secured against the outer surfaces 42 of their respective clamp elements 12, 14. Given the manner in which the cord 52 is interwoven between the clamp members 12, 14 and the brackets 56, 58, a downward force exerted on the grip 78 translates the force by the first elongated edge is 18 onto the top edges 74 into a lateral biasing force by the second elongated edges 20 against the outer surface 54. In this manner, the majority of the force exerted as a result of downward force on the grips 78 is transformed into a bias against the outer surfaces 54 of the door frames 38.

Figure 4:
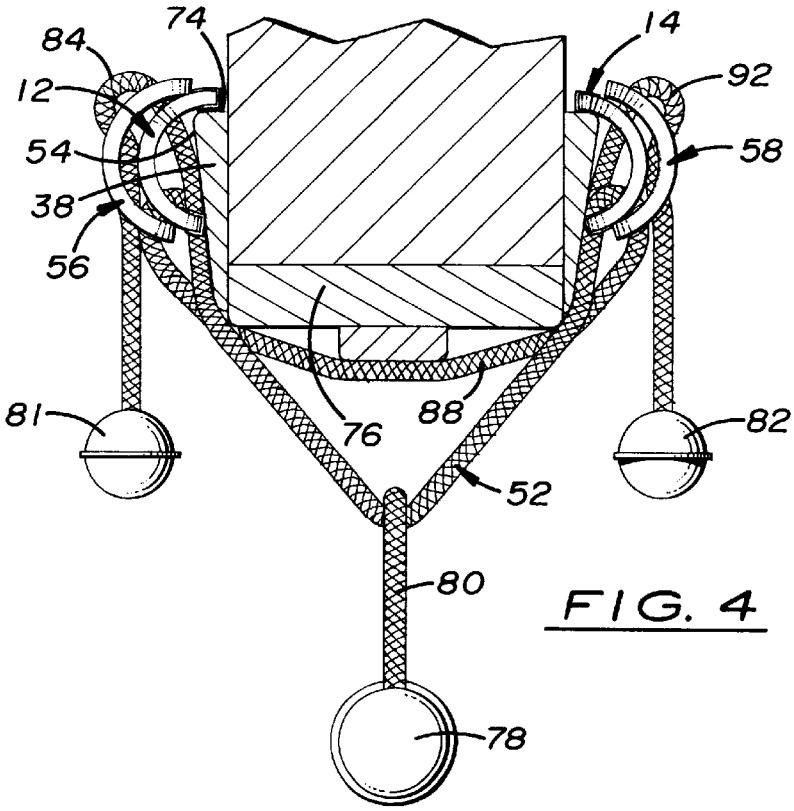
FIG. 4 is a cross-sectional view, with some parts in elevation, taken substantially along line 4—4 of FIG. 2.
Figure 4A:
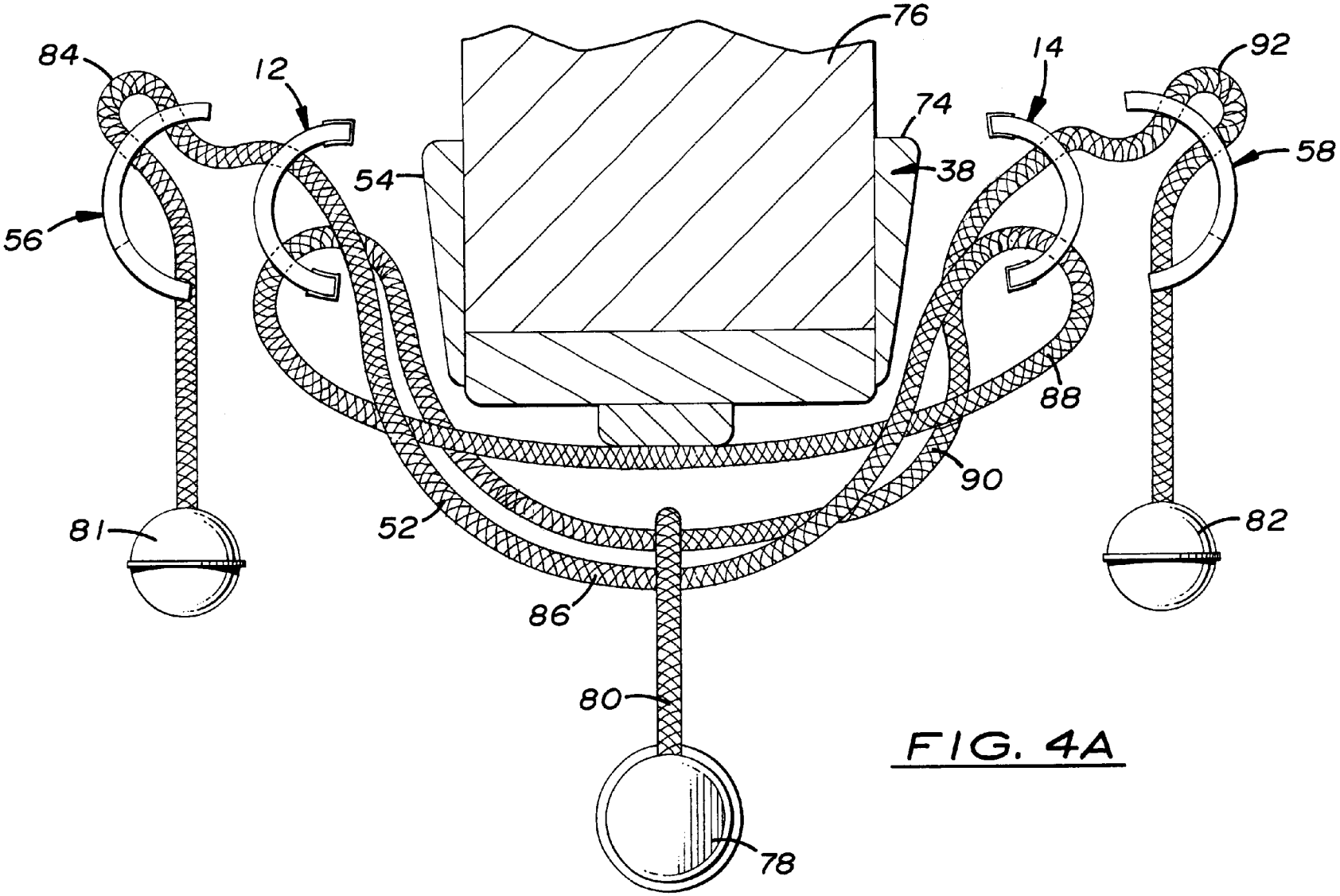
FIG. 4A is a cross-sectional view, with some parts in elevation, similar to that of FIG. 4 but illustrating the components of the present invention in exploded, non-tightened position.
Figure 5:
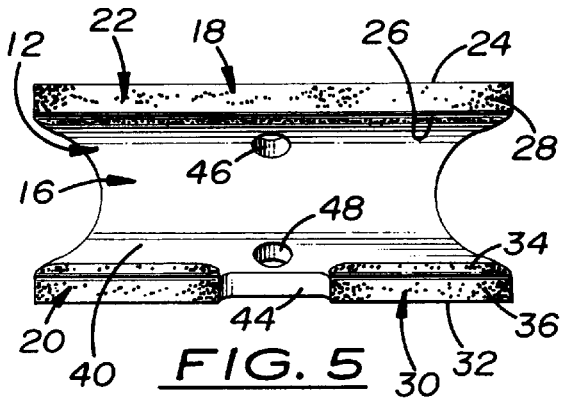
FIG. 5 is a front, interior elevation of the clamp member of one preferred embodiment of the present invention.
Figure 6:
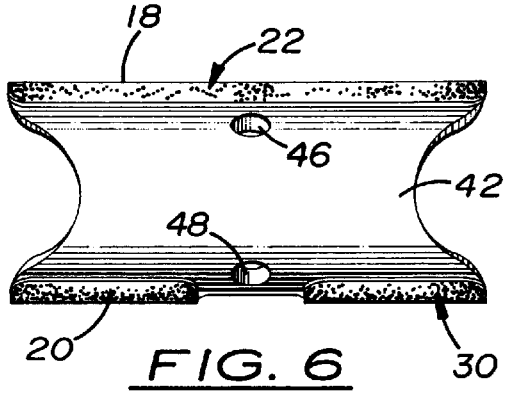
FIG. 6 is a rear, exterior elevation of the clamp member illustrated in FIG. 5.
Figure 7:
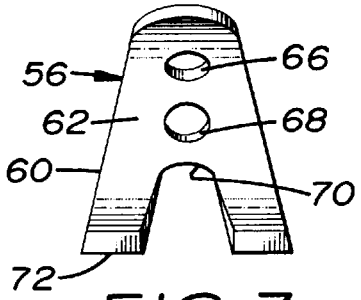
FIG. 7 is a front, interior elevation of the leverage bracket of one preferred embodiment of the present invention.
Figure 8:
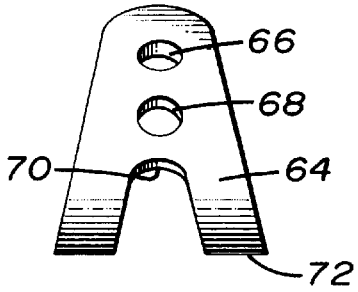
FIG. 8 is a rear, exterior elevation of the leverage bracket illustrated in FIG. 7.

To accomplish the leveraging mechanism of the embodiment described above, the cord 52 is interwoven between the clamp members 12, 14 and the brackets 56, 58 in the following manner as clearly shown in FIG. 4A. Each end of the cord 52 preferably is capped by terminal ball members 81, 82 so that the cord 52 does not inadvertently slip out of place. The first end of the cord 52 from the ball 81 passes through a notch 70 in the bracket 56, out through the aperture 68 and back into the aperture 66 so as to form a small loop 84 over the outer surface 64 of the bracket 56. The cord 52 then passes through the upper aperture 46 of the clamp member 12 from the exterior surface 42 to the interior surface 40 thereof. The cord 52 then passes all long the interior surface 40 of the clamp member 12, through the notch 44 and across to the opposite clamp element 14. This first attachment member loop 86 passes beneath the doorway 76. The cord 52 then passes through the notch 44 of the second clamp element 14, through the second aperture 48 from the interior surface 40 to the exterior surface 42, and then back across the bottom of the doorway 76 to form a second loop 88. The cord 52 then passes through the second aperture 48 of the first clamp member 12 from the exterior surface 42 to the interior surface 40, back through the notch 44 and then across the bottom of the doorway 76 to form the third loop 90. The cord 52 then passes up through the notch 44 of the second clamp element 14, through the upper aperture 46 from the interior surface 40 to the exterior surface 42 of the clamp member 14, and through the upper aperture 66 of the bracket 58. When the cord 52 passes through the apertures 66 of the bracket 58, it passes from the interior surface 62 to the exterior surface 64, forms a final small loop 84 over the outer surface 64 of the bracket 58, and then passes back through the second aperture 68 to the interior surface 62 and through the notch 70 to terminate in the terminal ball 82. In this manner, the length of the cord 52 can be adjusted for the width of the doorway 76. Moreover, the terminal balls 81, 82 may be pulled downwardly to cinch the brackets 56, 58 tightly against the clamp members 12, 14 once the device 10 is in place.

Figure 3:
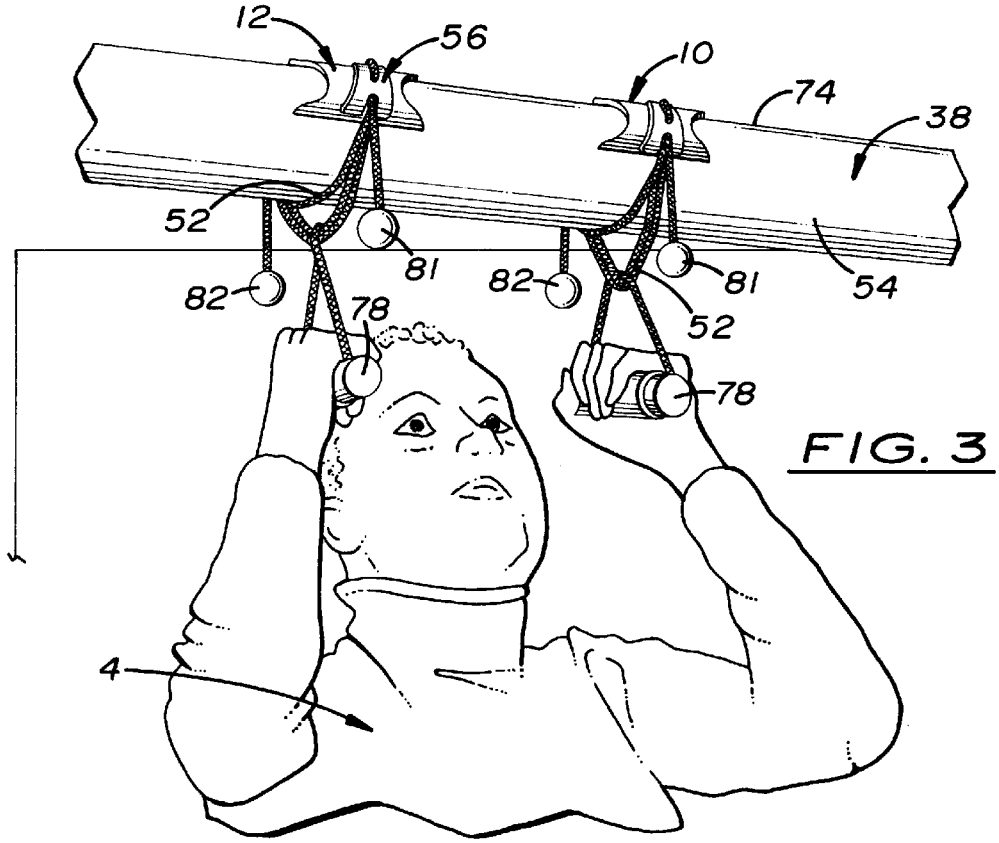
FIG. 3 is a perspective view similar to that of FIG. 2 but illustrating an individual utilizing the device of the invention.

In this preferred embodiment, the rope 80 of the grip 78 passes over the loops 86, 90 of the cord 52. The loop 88 is tightly drawn across the bottom of the doorway 76, while the loops 86, 90 are loosely maintained under the doorway 76. Thus, when a downward force is exerted on the grip 78, the cord 52 is tightly sandwiched between the notches 44 of the clamp members 12, 14 and the face 54 of the door frames 38. Moreover, the brackets 56, 58 are cinched tightly against the clamp members 12, 14. In this manner, the second elongated edges 20 of the clamp members 12, 14 are forced laterally inwardly against the face or outer surface 54 of the frame 38. As a result, a significant amount of weight can be hung from the hand grip 78. When a pair of the devices 10 are hung on a door frame 38 as indicated in FIG. 3, a person weighing up to 300 pounds can hang from the grips 78 without affecting the structural integrity of the frame 38 due to the bias force created by the devices 10. In preferred form, the cord 52 is ¼ inch nylon rope, although any appropriate size and type of rope or cord may be utilized.

Figure 9:
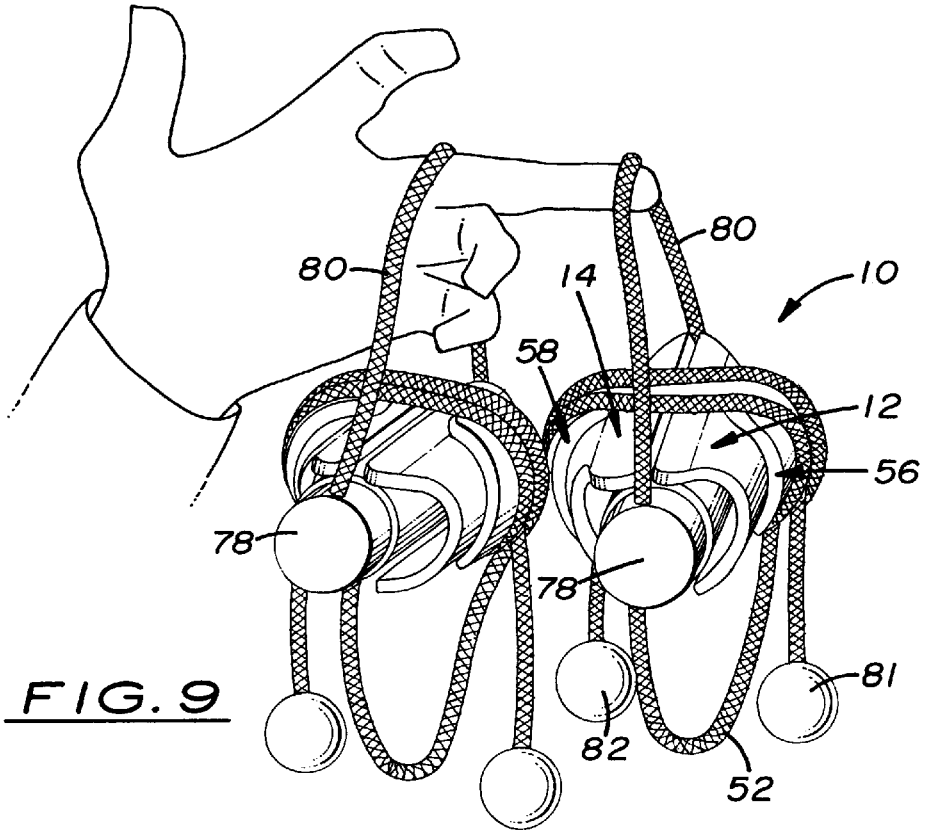
FIG. 9 is a perspective view of the first embodiment of the present invention as illustrated in FIGS. 1 and 2 but folded in its transport and storage position.
Figure 10:
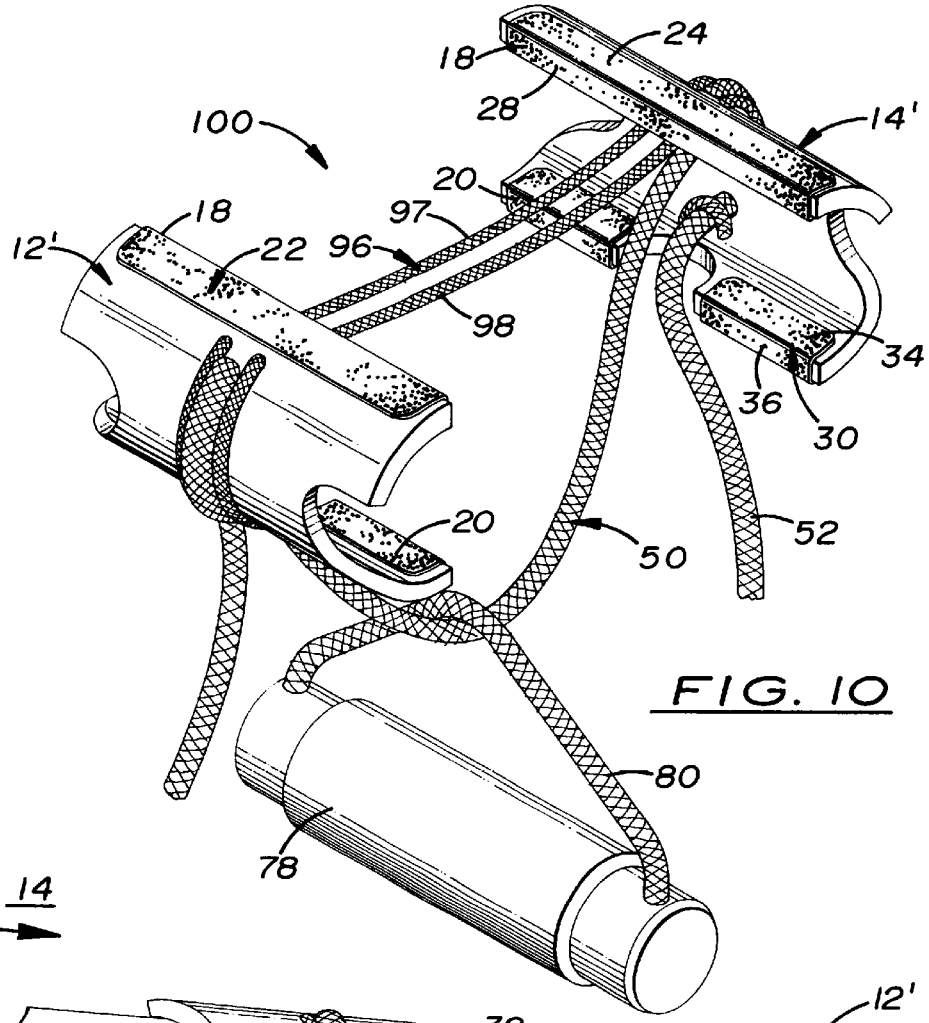
FIG. 10 is a perspective view of a second exercise device embodiment constructed in accordance with the present invention.
Figure 11:
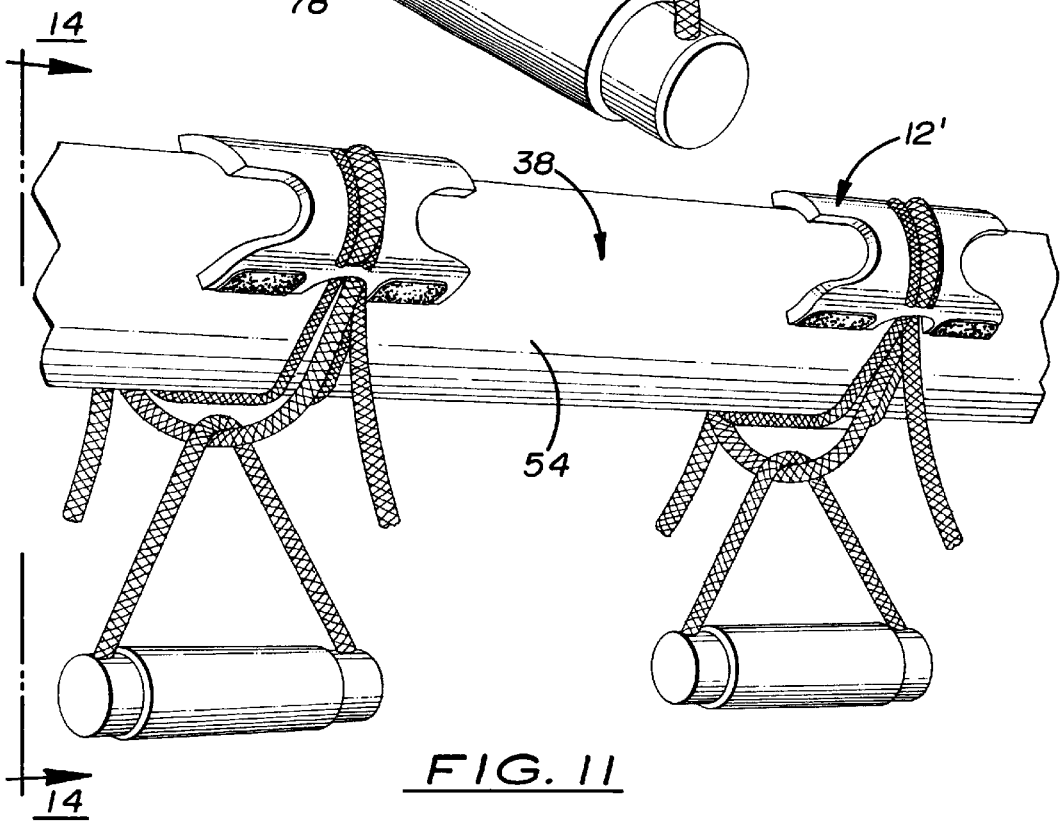
FIG. 11 is a perspective view of an exercise device using the embodiment of FIG. 10 and installed onto a door frame.
Figure 12:
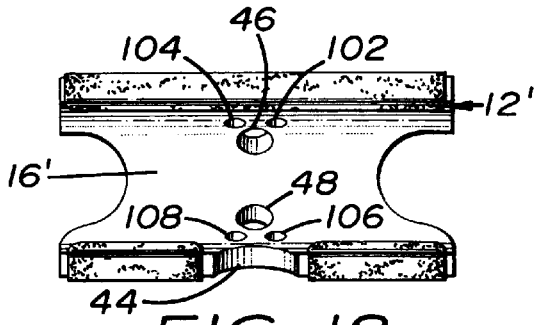
FIG. 12 is a front, interior elevation of the clamp member of the second preferred embodiment of the present invention.
Figure 13:
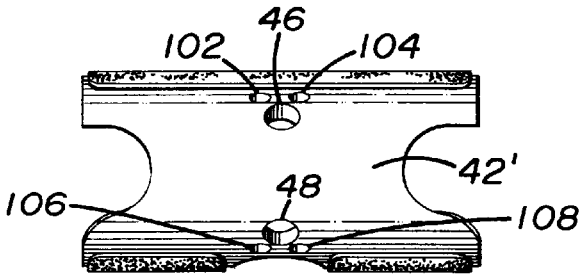
FIG. 13 is a rear, exterior elevation of the clamp member illustrated in FIG. 12.
Figure 14:
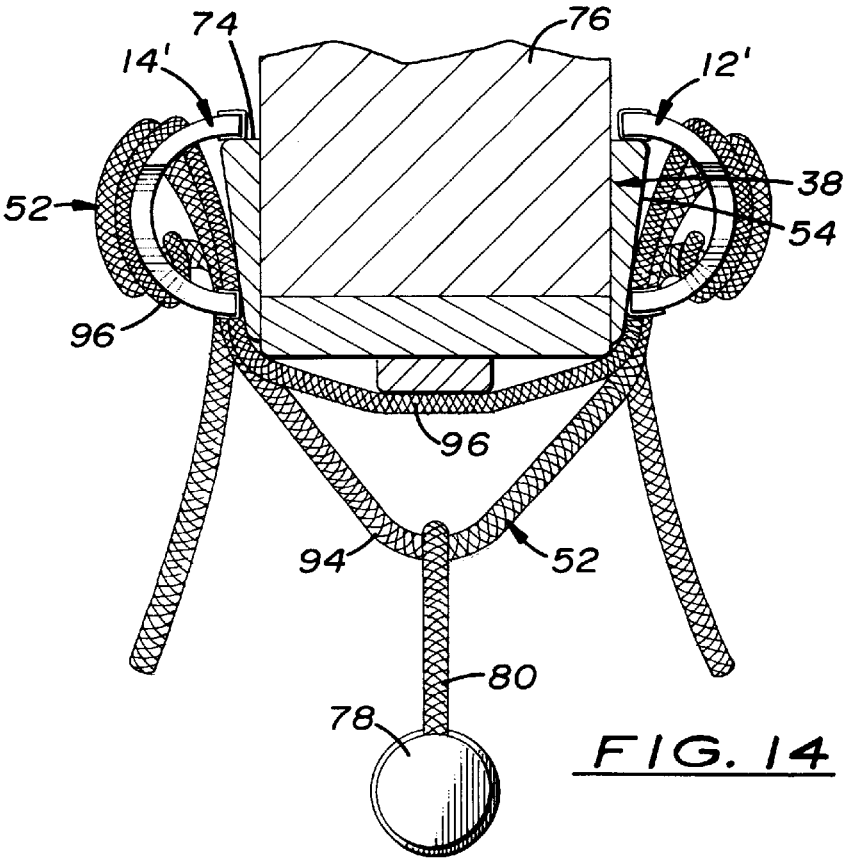
FIG. 14 is a cross-sectional view, with some parts in elevation, taken substantially along line 14—14 of FIG. 11.

As can be readily appreciated from the above, the cord 52 can be adjusted so that the device 10 can fit a wide variety of doorway sizes and widths. Moreover, the devices 10 can be placed along the frame 38 at any desired location. For example, referring to FIG. 3, the individual 4 using the devices 10 to exercise by performing chin-ups:can position the devices 10 as illustrated so that they are approximately over the shoulders of the individual 4 using the devices 10. On the other hand, the devices 10 can be spread much further apart so that they are no longer over the shoulders of the user 4 but rather further apart so as to use different shoulder muscles when exercising. When it is desired to store or transport the device 10, the components thereof can be easily folded on top of each other as illustrated in FIG. 9 without having to take the components apart. The total weight of a pair of the devices 10 is preferably less than one lb., thereby making them very attractive for use when traveling.

Referring now to FIGS. 10–14, another embodiment of the invention is illustrated herein. In this particular embodiment, like components will have like numerals to the prior embodiment. In this particular embodiment, the device 100 includes clamp elements 12', 14' which are constructed in the same manner as the prior embodiment. It should be noted that the clamp members 12', 14' may be of difference sizes than the members 12, 14. The only limiting factor is that the clamp elements 12', 14' not be so large that the second elongated edges 20 pass beneath the doorway 76. In the device 100, the attachment member 50, while in the form of a cord 52, is wound through the clamp members 12', 14' with only one loop 94 being formed. The grip 78 with its attachment cord 80 is looped over the one loop 94 and depends therefrom in a manner similar to that of prior embodiment. In this particular embodiment, the leverage mechanism includes the use of a resilient member 96 which preferably is in the form of a bungee-type resilient cord. This resilient cord 96 is preferably a continuous loop between the clamp elements 12', 14'. In preferred form, each clamp element 12', 14' includes a pair of openings 102,104 proximate the upper aperture 46 as well as a second set of openings 106,108 proximate the lower aperture 48. In this manner, the resilient member 96 passes through an opening 102 of the clamp element 12', over the outer surface 42' into the aperture 106, back through the aperture 108, back across the outer surface 42' and into the aperture 104. The resilient member 96 then passes across to the opposite clamp member 14' and through the openings 102,104,106 and 108 thereof in like manner. Consequently, two strands 97,98 of the cord 96 pass between the clamp members 12', 14'. Inasmuch as the cord 96 is resilient, it can be stretched so as to vary the distance between the clamp members 12', 14', thereby enabling the device 100 to be adjusted to various widths of a doorway 76.

In preferred form, the cord 52 passes up through a notch 44 of the clamp element 12', into the lower aperture 48, across the outer surface 42' and into the upper aperture 46. It then forms the loop 94 and passes over to the upper aperture 46 of the opposite clamp member 14'. It passes into the upper aperture 46, across the outer surface 42', back into the lower aperture 48 and out through the notch 44 of the second clamp member 14'. In this manner, when a device 100 is placed onto a door frame 38, both the cord strands 97, 98 as well as the cord 52 are sandwiched between the notches 44 of the clamp members 12', 14' and the face 54 of the door frame 38 in a manner similar to the prior embodiment. However, in this embodiment, the resilient nature of the cord 96 assists in biasing the second elongated edges 20 of the clamp members 12', 14' against the frame surface 54, and when a downward force is applied onto the hand grip 78, the lateral force against the wall 54 by the second elongated edges 20 significantly increases in a manner similar to that of the prior embodiment.

As can be seen from the above, the present invention provides a unique exercise device that is lightweight and portable. The advantages of such portability is that the device may be readily carried when traveling and used with any size doorway frame. Thus, it is an ideal device for people who wish to travel yet maintain an exercise regimen while traveling. Moreover, it is readily used in an office environment, at home and the like since the device is easy to set up and take down. The device of the present invention is easy to secure to the upper frame of a doorway, and once in place, it is easily locked into position by pulling down on the grip member and leveraging the device against the door frame outer surface. Once the rope or cord of the present invention is drawn up and the hand grip pulled down, the cord binds against the device edges and is sandwiched between the device and the door jam. This arrangement causes the device of the invention to create a lateral bias force against the door frame rather then a downward force on the upper edge of the door frame. This translation of the downward force into a lateral bias force prevents the door frame from being torn from the door as a result of sizable weight being exerted on the hand grip of the device. Finally, the present invention may be positioned along the upper frame of a doorway and a variety of different manners to provide exercise of different muscle groups due to the distance between the devices when placed over a doorway.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. An exercise device for use with a support frame, said device comprising:

a pair of spaced clamp members each having a body portion terminating in first and second edges;

a length-adjustable flexible attachment member interwoven between said clamp members to interconnect the same;

a grip element associated with said attachment member intermediate said clamp members; and a leverage mechanism operatively connected to said clamp members and adapted, when said clamp member first edges are supported on a frame to urge said clamp member second edges laterally inwardly against the support frame in response to a downward force exerted on said grip element.

2. The exercise device as claimed in claim 1, wherein said grip element extends from said attachment member and is adapted to enable a user to exercise using the same.

3. The exercise device as claimed in claim 1, wherein said first and second edges of each said clamp member are spaced opposite each other.

4. The exercise device as claimed in claim 3, wherein each said clamp member is arcuate in shape to form a jaw-like body portion.

5. The exercise device as claimed in claim 1, wherein said length-adjustable flexible attachment member comprises a cord interwoven between said clamp members.

6. The exercise device as claimed in claim 5, wherein said device further includes a resilient element interconnecting said clamp members.

7. The exercise device as claimed in claim 6, wherein said leverage mechanism comprises said resilient element interconnecting said clamp members proximate the first edges thereof, and said cord interlocking said clamp members proximate both said first and second edges of each clamp member to sandwich said cord between the second edge of each said clamp member and the face of the frame when an outward force is exerted on said grip element positioned along said cord intermediate said clamp members.

8. The exercise device as claimed in claim 5, wherein said cord forms a plurality of loops passing between said clamp members while being interwoven between the first and second edges of each said clamp member.

9. The exercise device as claimed in claim 8, wherein said leverage mechanism comprises said interwoven cord and a pair of leverage brackets, each said bracket being associated with one said clamp member and interwoven with said cord.

10. The exercise device as claimed in claim 9, wherein said brackets are positioned against the outer surface of said clamp members and are interwoven so that said cord interlocks said clamp members and said brackets proximate both said first and second edges of said clamp members to sandwich said cord between the second edge of each said clamp member and the face of the frame when an outward force is exerted on said grip element positioned along said cord intermediate said clamp members.

11. A portable exercise device adapted for temporary attachment to the frame of a door for use by an individual, said device comprising a pair of spaced-apart clamp members adapted for positioning on opposite sides of a door frame, each having a body portion with a substantially arcuate shaped cross-section, and first and second elongated edges spaced opposite each other and adapted for engagement with a door frame;

a length-adjustable flexible attachment member interwoven between said clamp members and adapted to adjust to the thickness of a doorway frame to enable said pair of clamp members to temporarily attach to the frame portion of a door on each side thereof;

a hand grip depending from said attachment member intermediate said clamp members; and a leverage mechanism connected to said clamp members and adapted to bias the second edges of said clamp members laterally against an outer surface of a door frame when the first edges of said clamp members are supported along an outer edge of the door frame and in response to force exerted on said hand grip by an individual using said device.

12. The exercise device as claimed in claim 11, wherein said length-adjustable flexible attachment member comprises a cord interwoven between said clamp members, and wherein said device further includes a resilient element interconnecting said clamp members.

13. The exercise device as claimed in claim 12, wherein said leverage mechanism comprises said resilient element, said cord, a pair of apertures disposed in each said clamp member one proximate each said first and second elongated edges, and a notch portion formed in the middle of each said second elongated edge, said cord passing between the clamp members up through said notch portion of each clamp member, looping through the first edge aperture, over the outer surface of said clamp member, back through the second edge aperture and down again through said notch portion, said notch portion being sized and shaped to pinch the loops of said cord disposed therein against the face of the door frame when an outward force is exerted on said grip element positioned along said cord intermediate said clamp members.

14. The exercise device as claimed in claim 13, wherein each said clamp member includes a first set of openings disposed proximate said first edge aperture and a second set of openings disposed proximate said second edge aperture, and wherein said resilient member forms a continuous loop between said clamp members passing through said first set of openings of each clamp member, over the outer surface of said clamp member, and looping through the second set of openings to pass back over the outer surface of said clamp member thereby linking the first edges of said spaced-apart clamp members.

15. The exercise device as claimed in claim 11, wherein said length-adjustable attachment member comprises a cord interwoven between said clamp members, said cord forming a plurality of loops passing between said clamp members while being interwoven between the first and second edges of each said clamp member, wherein said leverage mechanism comprises said interwoven cord and a pair of leverage brackets each being positioned against the outer surface of one said clamp member and interwoven with said cord, and wherein said brackets are interwoven so that said cord interlocks said clamp members and said brackets proximate both said first and second edges of said clamp members to sandwich said cord between the second edge of each said clamp member and the face of the door frame when a force is exerted on said grip element positioned along said cord intermediate said clamp members.

16. The exercise device as claimed in claim 15, wherein a first pair of apertures are disposed in each said clamp member one proximate each said first and second elongated edges, a notch is defined in the middle of each said second elongated edge, and a second pair of apertures are formed in each said bracket one each proximate the top and bottom edges thereof, said cord passing through the apertures of a first bracket, through the first edge aperture and notch of the adjacent first clamp member, across to the notch and second edge aperture of the second opposite clamp member, back across to the notch and second edge aperture of the first clamp member, and then back across through the notch and first edge aperture of the second opposite clamp member and into and over the second bracket adjacent the second opposite clamp member, thereby looping back and forth between the clamp members to pinch the loops of said cord disposed in the notches of each second edge of each clamp member against the face of the door frame on both side thereof when a force is exerted on said grip element positioned along said cord loops intermediate said clamp members.

17. A chin-up apparatus for use with an overhead door frame including a pair of separately attachable and adjustable hand grip devices, each said hand grip device comprising:

a pair of clamp members each having a substantially semicircular body portion terminating in first and second elongated edges, said body portion being sized to engage said first edge with an upper edge of an overhead door frame and said second edge with the outer surface of said overhead door frame;

an elongated cord interconnecting said clamp members and being length adjustable therebetween to enable adjustment of the cord to the width of the overhead door frame;

a hand grip depending from said cord intermediate said clamp members; and a leverage mechanism adapted to translate the downward force exerted on the first clamp member edges against an upper edge of an overhead door frame to a lateral bias force exerted by said second clamp member edges against the outer surface of said overhead door frame in response to a downward force exerted on the hand grip by an individual using said device.

18. The exercise device as claimed in claim 17, wherein said interconnecting cord forms a plurality of loops passing between said clamp members while being interwoven between the first and second edges of each said clamp member, and wherein said leverage mechanism comprises said interwoven cord and a pair of leverage brackets each being positioned proximate the outer surface of one said clamp member and interwoven with said cord to translate said downward force to said lateral force by urging said clamp member second elongated edges in a rotational direction into said door frame relative to said first edges.

19. The exercise device as claimed in claim 18, wherein said brackets are interwoven so that said cord interlocks said clamp members and said brackets proximate both said first and second edges of said clamp members to sandwich said cord between the second edge of each said clamp member and the face of the door frame when a downward force is exerted on said grip element positioned along said cord intermediate said clamp members.

20. The exercise device as claimed in claim 19, wherein a first pair of apertures are disposed in each said clamp member one proximate each said first and second elongated edges, a notch is defined in the middle of each said second elongated edge, and a second pair of apertures are formed in each said bracket one each : proximate the top and bottom edges thereof, said cord passing through the apertures of a first bracket, through the first edge aperture and notch of the adjacent first clamp member, across to the notch and second edge aperture of the second opposite clamp member, back across to the notch and second edge aperture of the first clamp member, and then back across through the notch and first edge aperture of the second opposite clamp member and into and over the second bracket adjacent the second opposite clamp member, thereby looping back and forth between the clamp members to pinch the loops of said cord disposed in the notches of each second edge of each clamp member against the face of the door frame on both side thereof when a downward force is exerted on said grip element positioned along said cord loops intermediate said clamp members.

* * * * *